US011241602B2

(12) United States Patent
Grissel, Jr.

(10) Patent No.: US 11,241,602 B2
(45) Date of Patent: Feb. 8, 2022

(54) EXERCISE WEIGHT POSITIONING DEVICE

(71) Applicant: Timothy Keith Grissel, Jr., Cedar Rapids, IA (US)

(72) Inventor: Timothy Keith Grissel, Jr., Cedar Rapids, IA (US)

( * ) Notice: Subject to any disclaimer, the term of this patent is extended or adjusted under 35 U.S.C. 154(b) by 2 days.

(21) Appl. No.: 16/696,047

(22) Filed: Nov. 26, 2019

(65) Prior Publication Data

US 2020/0164242 A1 May 28, 2020

Related U.S. Application Data

(60) Provisional application No. 62/771,804, filed on Nov. 27, 2018.

(51) Int. Cl.
*A63B 21/078* (2006.01)
*A63B 21/072* (2006.01)

(52) U.S. Cl.
CPC ..... *A63B 21/078* (2013.01); *A63B 21/0724* (2013.01)

(58) Field of Classification Search
CPC . A63B 21/078; A63B 21/0724; A63B 21/072; A63B 21/0722; A63B 21/0726; A63B 21/0728
See application file for complete search history.

(56) References Cited

U.S. PATENT DOCUMENTS 3,268,224 A * 8/1966 Freshour ..... A63B 17/00 482/104
4,861,024 A * 8/1989 Lee ..... A63B 23/00 482/104
5,460,588 A * 10/1995 Tate ..... A63B 21/078 482/104
2019/0247701 A1* 8/2019 Sergakis ..... A63B 21/078

OTHER PUBLICATIONS https://www.reddit.eom/r/homegym/comments/808sdx/rollingjcup_prototypes/; Feb. 25, 2018; bediamond.*

* cited by examiner

*Primary Examiner* — Nyca T Nguyen
*Assistant Examiner* — Andrew M Kobylarz
(74) *Attorney, Agent, or Firm* — Shuttleworth & Ingersoll, PLC; Brett D. Papendick

(57) ABSTRACT

An exercise weight positioning device allows a barbell portion of the exercise weight to be positioned in a recessed portion of the positioning device. The positioning device is tapered toward the recessed portion. Additionally, the positioning device is rotatable around an axis. This feature allows the positioning device to rotate when the barbell moves laterally in relation to the positioning device.

15 Claims, 8 Drawing Sheets

EXERCISE WEIGHT POSITIONING DEVICE

CROSS-REFERENCE TO RELATED APPLICATIONS

The present application claims priority to provisional patent application 62/771,804 which was filed on Nov. 27, 2018, and is hereby expressly incorporated by reference in its entirety.

BACKGROUND

Due to their nature, exercise weights are heavy and unwieldy, and optimal use requires specific positioning of the weights prior to beginning exercise activities. Commonly used weights include dumbbells and barbells. Both of these types of weights consist essentially of a central gripping bar with one or more removable weights attached to each end of the dumbbell or barbell. The primary difference between the two is that dumbbells are designed for being gripped with one hand during use, whereas barbells are meant to be gripped with both hands. A barbell typically has a wider bar, usually arranged centrally across the body of a user. Barbell and dumbbell-based weight systems typically include bars that are substantially cylinders with diameters sized for gripping in the hands of a user. Barbells in particular see use with large amounts of weights for certain exercises in weight lifting communities.

For optimal use in weight lifting exercises, weights have a preferred starting position for each exercise relative to the user's body. It is important, especially for barbell-based exercises, that the weight be evenly distributed to the right and left of the user at the beginning of a set of exercises to ensure balance is maintained throughout the exercise set and that the results of the exercise are optimal. After use for exercise activities, the user's strength is often nearly exhausted and precise positioning post-exercise is uncommon and difficult to perform, with a large area to place the weights with a back stop to prevent misplacement of the weights desirable. A J-cup is a common example, well known in the art, of a wide area support structure with a back stop to enable weights to be placed back into a resting position post-exercise. J-cups are commonly used with a variety of exercise equipment including, but not limited to, racks, bench presses, and monolifts.

Two problems recognized in the art are that weights are difficult to move both side-to-side, as well as forward and backwards after being placed within a positioning/support rack. The prior art shows some examples of devices intended to partially address the forward and backward movement issue, but no device effectively addresses both issues simultaneously.

It is an object of the present invention to facilitate easier movement of exercise weights forward or backwards to a preferred starting location.

It is a further object of the present invention to facilitate easier movement of exercise weights side to side to ensure the weight is evenly distributed.

It is yet a further object of the present invention to facilitate both forward and backward positioning and side to side positioning simultaneously.

SUMMARY OF THE INVENTION

The exercise weight positioning device can be added to an existing exercise bench or J-cup, but preferably it is manufactured and placed during the manufacture of the exercise bench or J-cup. The positioning device is located within the J-cup of a piece of exercise equipment such as an exercise bench. The positioning device is rotatable on a longitudinal axis and secured to the J-cup via fasteners.

The positioning device is preferably a tapered cylindrical shape with a first side having a larger diameter than a second side opposite of the first side. At a point between the first side and second side, a middle section of the positioning device is recessed. The recessed portion is configured to receive the bar section of a barbell.

As the user of the positioning device places a barbell on the positioning device, lateral movement of the barbell on the positioning device will result in rotation of the positioning device on the longitudinal axis. Furthermore, as the positioning device is tapered toward the recesses portion, the barbell will naturally through gravity locate to the recessed portion.

DETAILED DESCRIPTION

Figure 1:
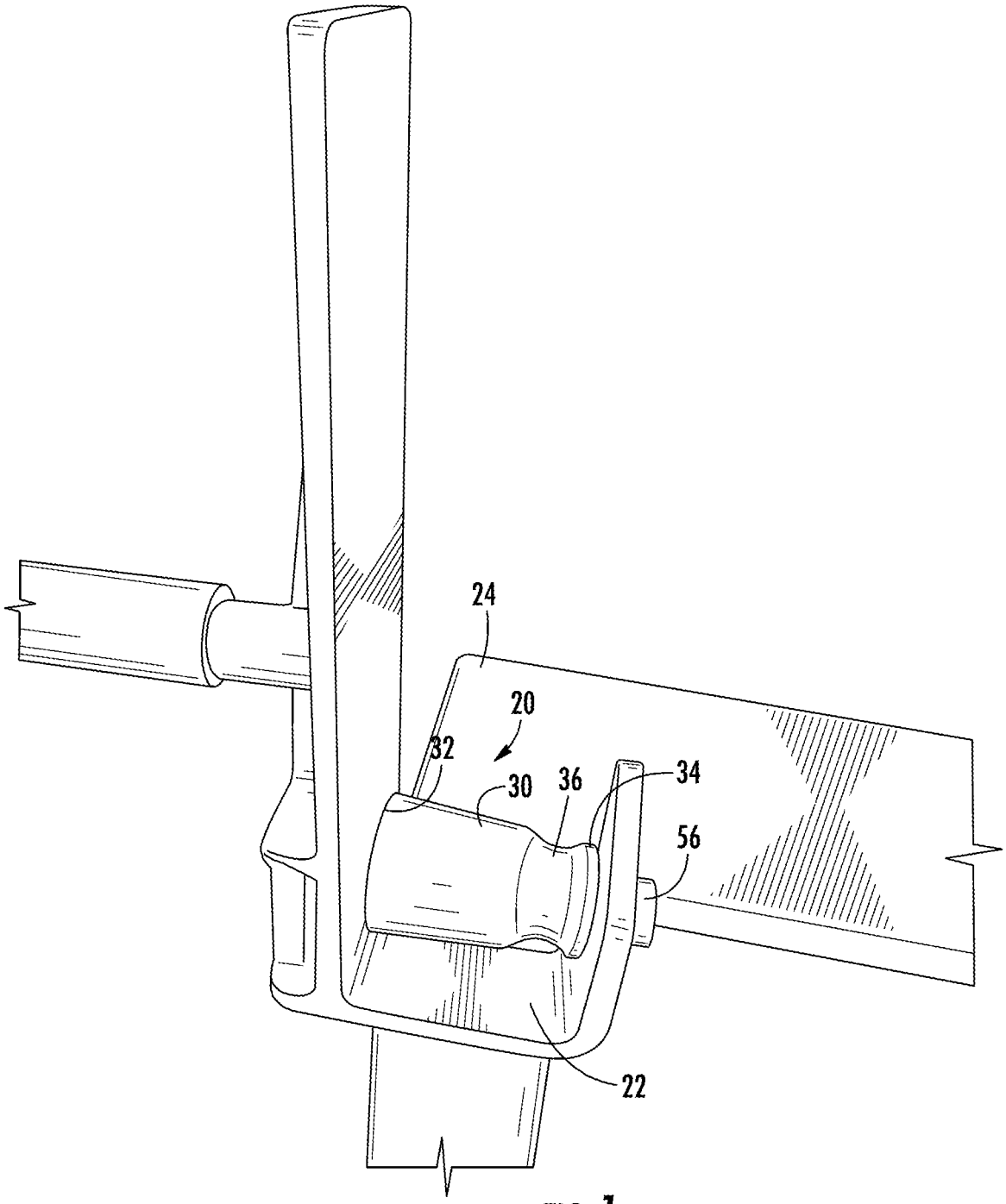
FIG. 1 is a perspective view of an exercise weight positioning device attached to a J-cup of an exercise bench.
Figure 2:
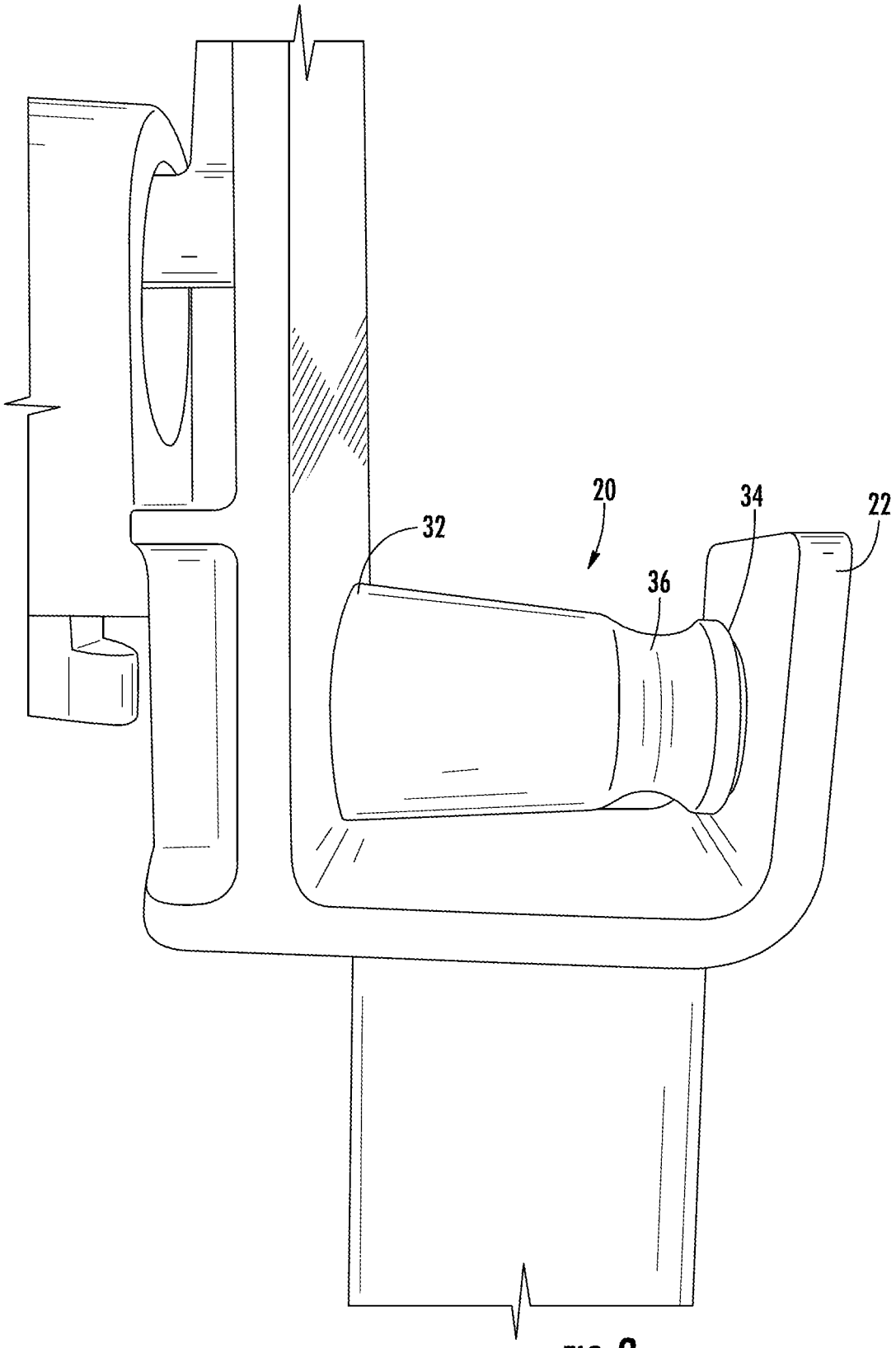
FIG. 2 is a side view of the positioning device.
Figure 3:
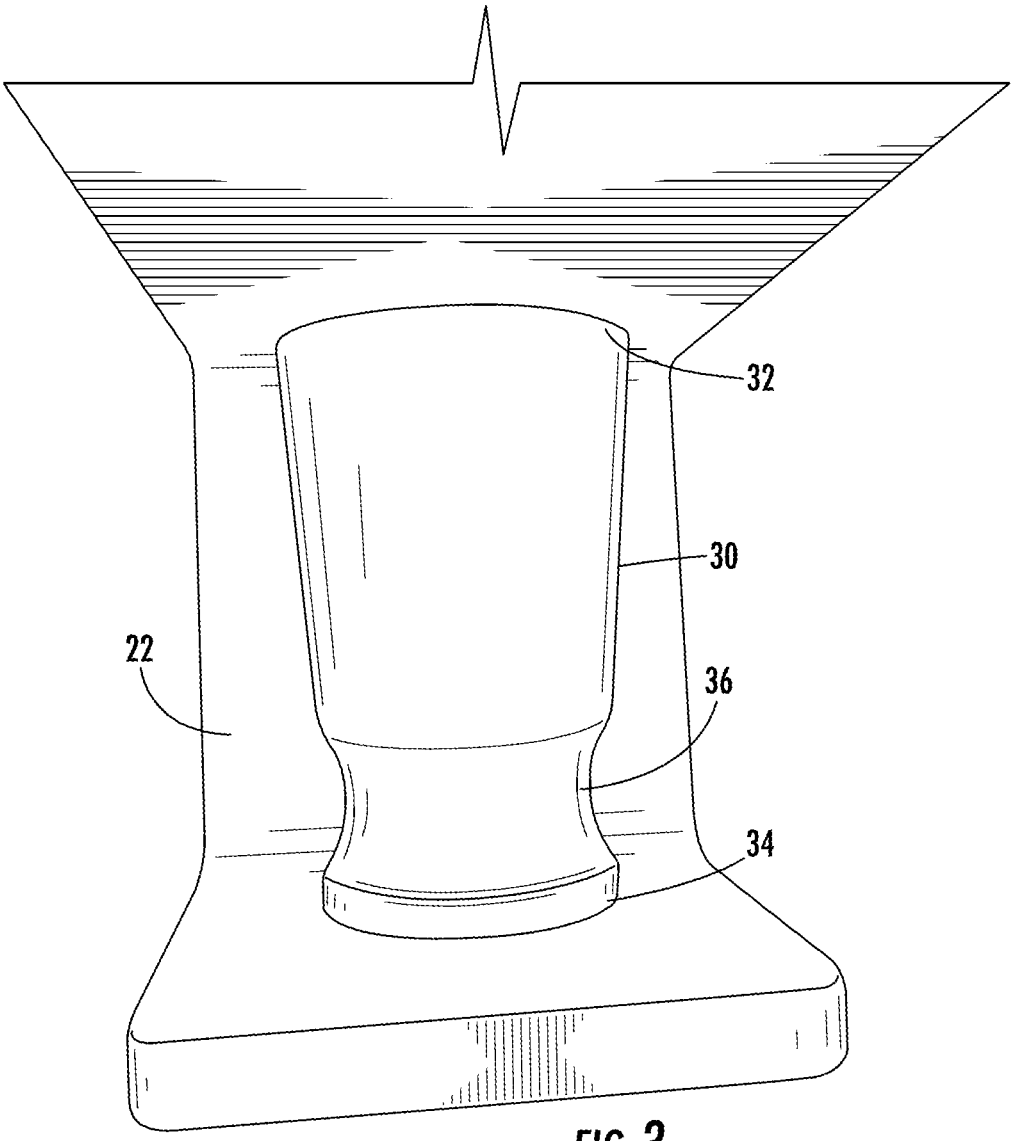
FIG. 3 is a top view of the positioning device.

Now referring to the drawings, FIGS. 1-9 show an exercise weight positioning device 20 attachable to a piece of exercise equipment 24, more specifically located within a J-cup 22 of the piece of exercise equipment 24. The exercise weight positioning device 20 has a main body 30 with a first end 32 and a second end 34.

Figure 7:
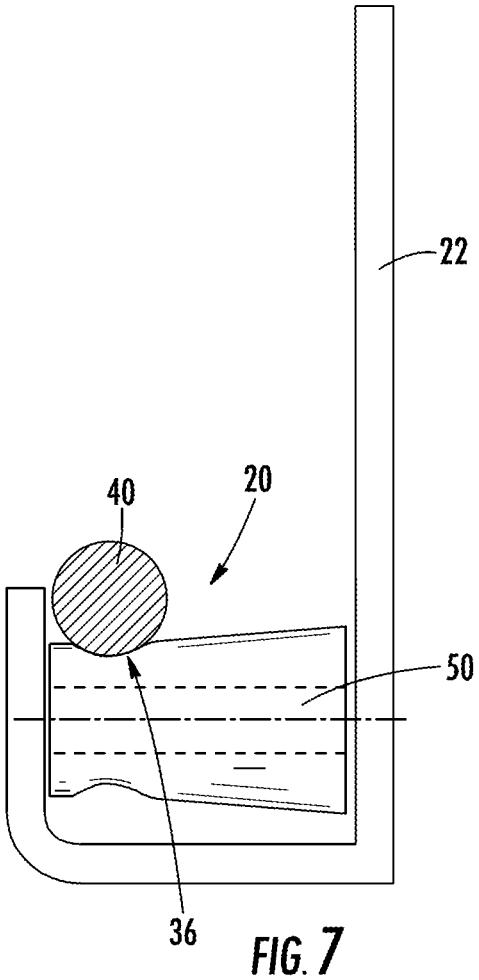
FIG. 7 is a side view of the positioning device showing a barbell and a J-cup.
Figure 8:
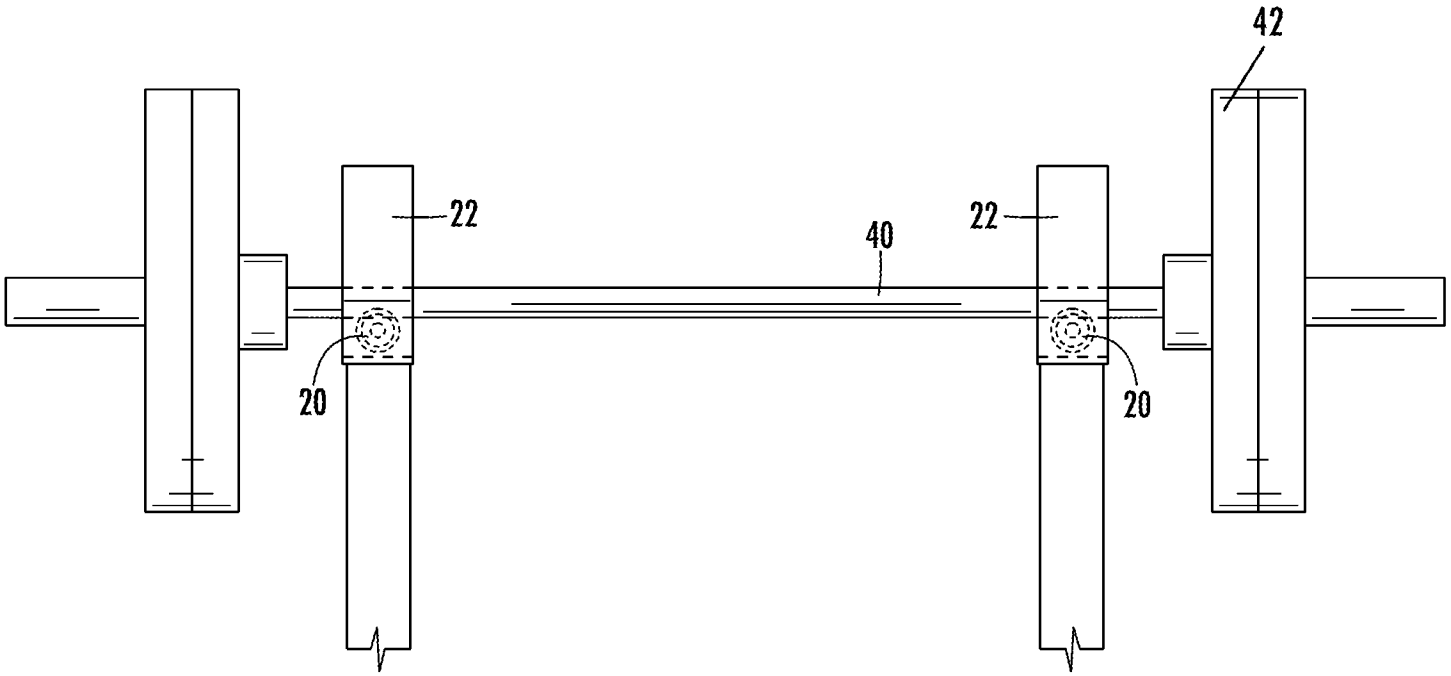
FIG. 8 is a front view of a barbell positioned on the positioning device.

Preferably, the positioning device 20 is a truncated tapered cylinder wherein the first end 32 has a greater diameter than the diameter of the second end 34. However, different shapes of the positioning device 20 could be utilized. In those alternate embodiments, it is sufficient that the main body 30 is sloped such that a barbell naturally is directed toward a recessed portion 36. The recessed portion 36 is in between the first end 32 and the second end 34. The recessed portion 36 is configured to receive the barbell portion 40 of exercise weights 42. Preferably, the recessed portion 36 is circular and is of a sufficient size to accommodate the barbell portion 40. Furthermore, the recessed portion 36 slopes downward to a bottom 37. As shown in FIGS. 7 and 8, the barbell portion 40 is laying within the recessed portion 36.

Figure 4:
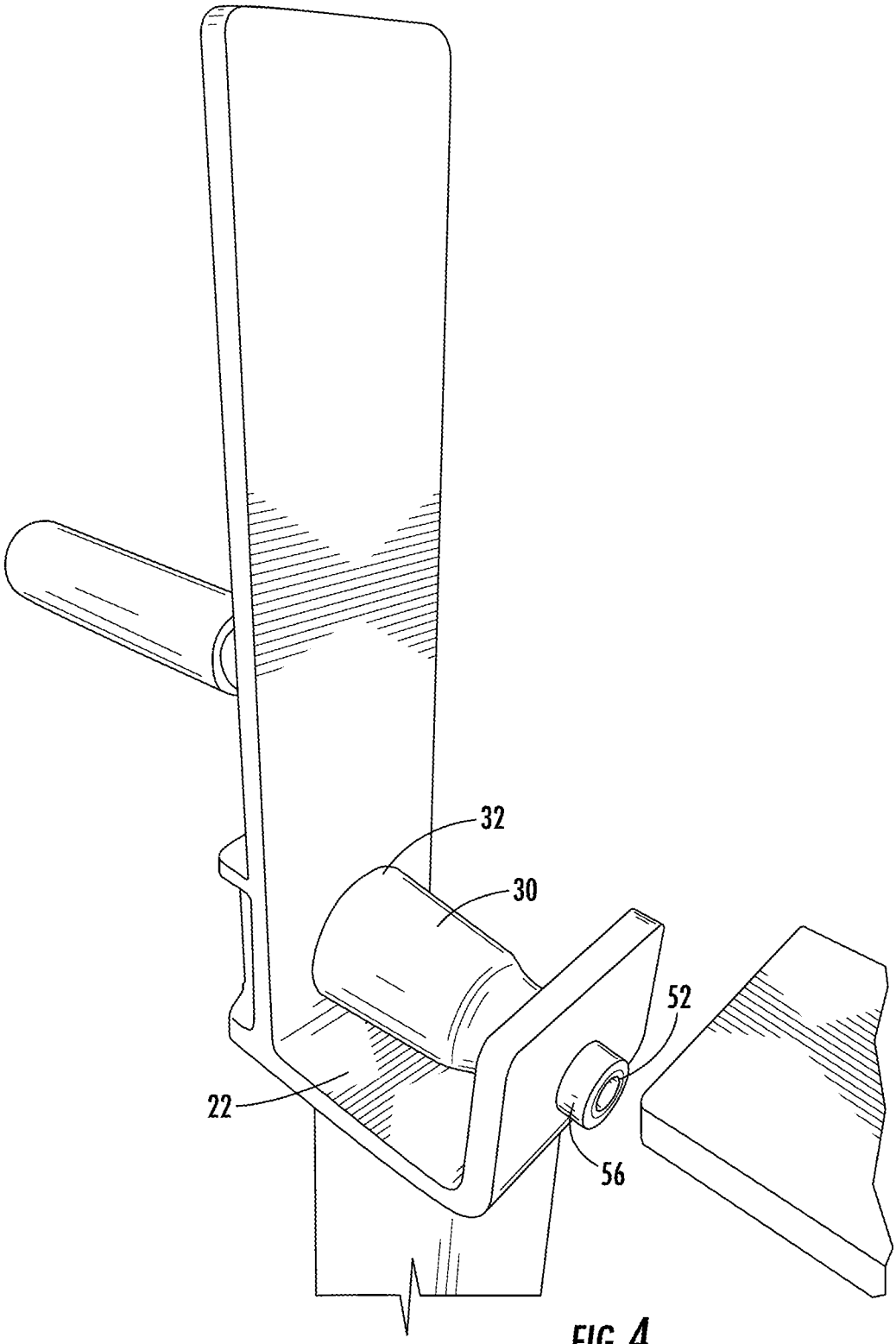
FIG. 4 is perspective view of the positioning device.
Figure 5:
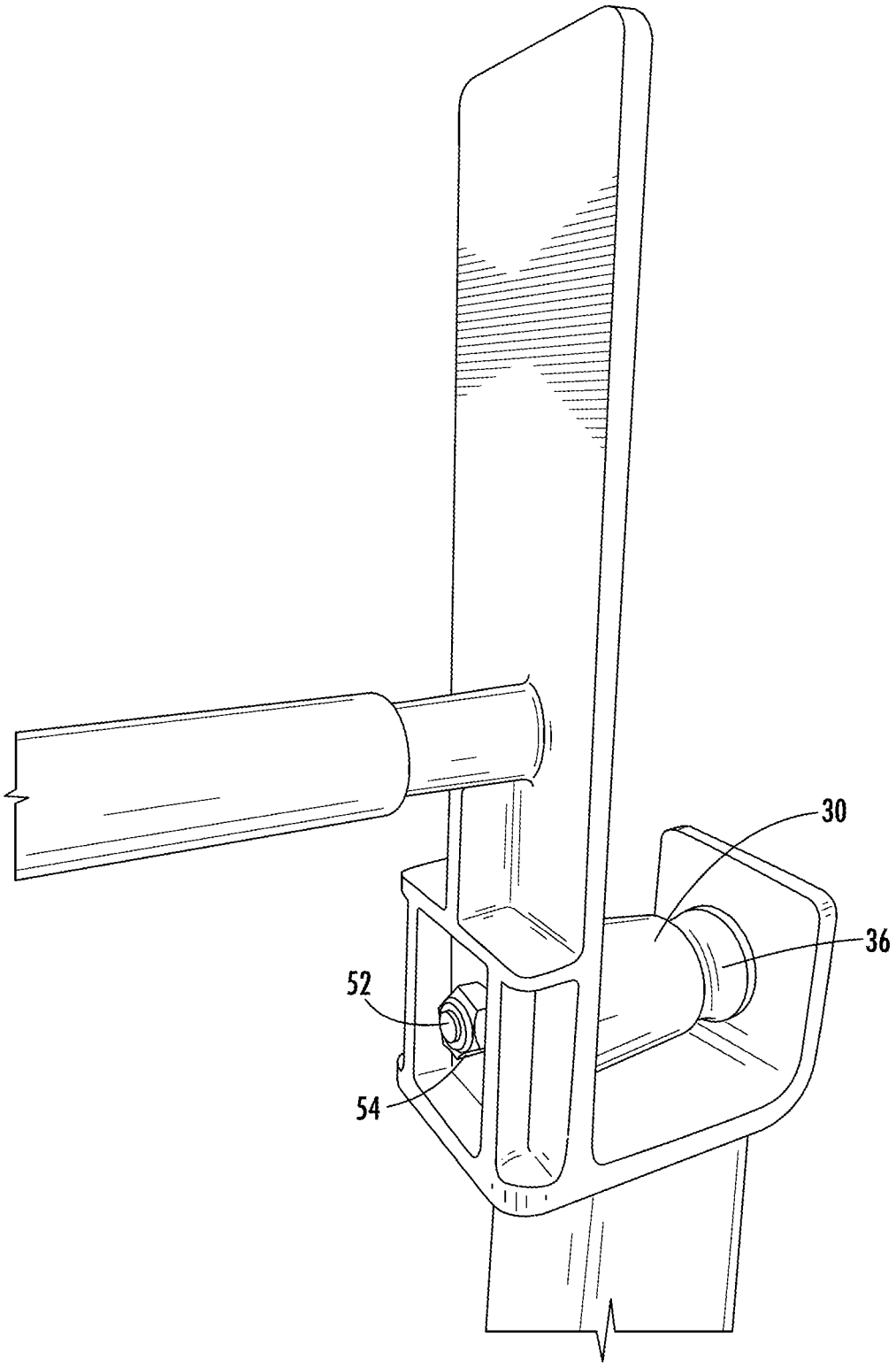
FIG. 5 is a rear perspective view of the positioning device showing the axle and fastener.
Figure 6:
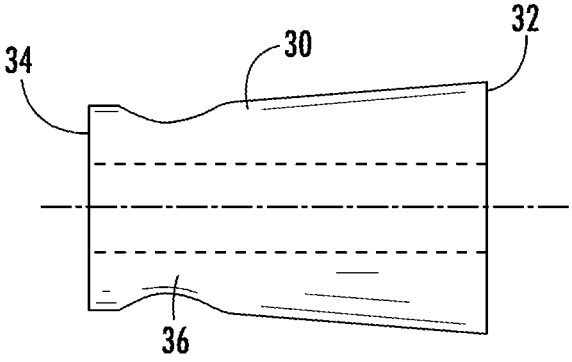
FIG. 6 is a side view of the positioning device.
Figure 9:
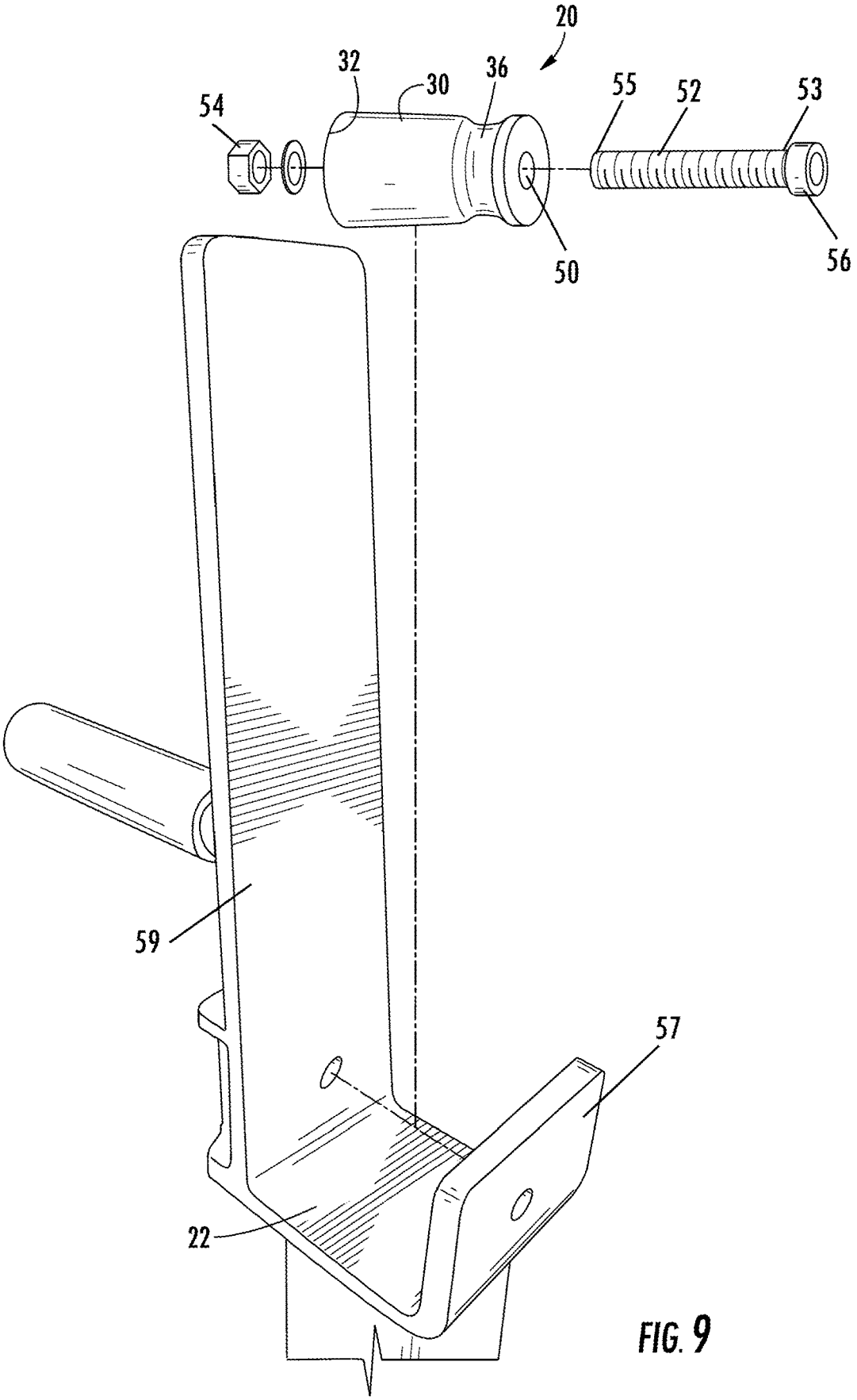
FIG. 9 is an exploded view of the positioning device.

In the preferred embodiment, the positioning device 20 has a cavity 50 best seen in FIGS. 7 and 9 spanning from the first end 32 to the second end 34. An axle 52 best seen in FIGS. 5 and 9 is inserted into the cavity 50 such that a first end 53 of the axle 52 protrudes from a first side 57 of the J-cup 22 and a second end 55 of the axle 52 protrudes from a second side 59 of the J-cup 22. As shown in FIGS. 4, 5 and 9, the axle 52 is secured by fasteners 54 and 56. Accordingly, the main body 30 is rotatable on the axle 52. The preferred embodiment has the axle 52 being a fixed axle. In another embodiment, the main body 30 and axle 52 can be one molded piece and rotatable within the fasteners 54 and 56.

In use, a user of the exercise weight positioning device 20 wherein the exercise weight positioning device 20 is attached to the J-cup 22 of the exercise equipment 24, places the barbell portion 40 of the exercise weights 42 such that the barbell portion 40 rests within the recessed portion 36 of the weight positioning device 20. In performing exercises such as a bench press, the user lifts the barbell portion 40 vertically above the exercise weight positioning device 20 and begins the typical movements associated with the bench press. When finishing up the repetitions, the user begins to place the barbell portion 40 back on the exercise weight positioning device 20. Any lateral movement of the barbell portion 40 rotates the exercise weight positioning device 20. This is the case whether the axle 52 is within the cavity 50 or if the axle 52 and main body 30 are one piece. Additionally, no matter where the barbell portion 40 is placed on the main body 30 of the exercise weight positioning device 20, the tapered shape of the exercise weight positioning device 20 allows the barbell portion 40 to come to rest within the recessed portion 36. The barbell portion 40 can now be pushed or pulled laterally to further position both the barbell portion 40 and the exercise weights 42 in a preferred position. As the barbell portion 40 is moved laterally, the exercise weight positioning device 20 rotates. The exercise weights 42 are now in an ideal position for the next user or exercise.

It is to be understood that the exercise weight positioning device 20 can be combined with J-cups 22 and retrofitted to an existing piece of exercise equipment 24. Furthermore, it is to be understood that the exercise weight positioning device 20 can be part of newly manufactured exercise equipment 24 having the J-cups 22 and the exercises weight positioning device 20 instead of retrofitting previously manufactured pieces.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is:

1. An exercise weight positioning device attached to a J-cup of a piece of exercise equipment, the exercise weight positioning device comprising:
- a main body;
- a first end;
- a second end;
- a recessed portion between the first end and the second end;
- the recessed portion configured to receive a barbell;
- the recessed portion is around the entirety of a perimeter of the main body;
- the exercise weight positioning device tapered from the first end to the recessed portion;
- wherein the recessed portion is configured to receive a portion of the barbell;
- a longitudinal axis spanning from the first end to the second end;
- the exercise weight positioning device is rotatable around the longitudinal axis.

2. The exercise weight positioning device of claim 1, further comprising:
- an axle;
- the axle located within a cavity of the exercise weight positioning device;
- the axle having a first end and a second end;
- the main body rotatable on the axle.

3. The exercise weight positioning device of claim 2, wherein:
- the exercise weight positioning device is selectively removable from the J-cup.

4. The exercise weight positioning device of claim 3, wherein:
- the main body is cylindrical.

5. The exercise weight positioning device of claim 4, wherein:
- the main body is tapered downward from the second end of the exercise weight positioning device to the recessed portion.

6. A J-cup for an exercise bench comprising:
- a first side and a second side;
- an exercise weight positioning device positioned between the first side and the second side;
- the exercise weight positioning device having,
  - a main body;
  - a first end;
  - a second end;
  - the exercise weight positioning device tapered from the first end to the second end to a recessed portion of the main body;
- the recessed portion configured to receive a barbell;
- the recessed portion is around the entirety of a perimeter of the main body;
- the exercise weight positioning device has a longitudinal axis spanning from the first end to the second end of the exercise weight positioning device;
- the exercise weight positioning device is rotatable around the longitudinal axis.

7. The J-cup of claim 6, wherein:
- the exercise weight positioning device has an axle;
- the axle located within a cavity of the exercise weight positioning device;
- the axle having a first end and a second end;
- the first end and the second end of the axle secured to the first side and the second side of the J-cup respectively;
- the main body rotatable on the axle.

8. The J-cup of claim 6, wherein:
- the exercise weight positioning device is selectively removable from the J-cup.

9. The J-cup of claim 8, wherein:
- the main body is cylindrical.

10. The J-cup of claim 9, wherein:
- the main body is tapered downward from the second side to the recessed portion.

11. An exercise bench, comprising:
- at least one J-cup;
- the at least one J-cup having a first side and a second side;
- an exercise weight positioning device positioned between the first side and the second side;
- the exercise weight positioning device having,
  - a main body;
  - a first end;
  - a second end;
  - a recessed portion;
- the recessed portion is around the entirety of a perimeter of the main body;
- the exercise weight positioning device tapered from the first end to recessed portion;

the exercise weight positioning device has a longitudinal axis spanning from the first end to the second end of the exercise weight positioning device;

the exercise weight positioning device is rotatable around the longitudinal axis.

12. The exercise bench of claim 11, wherein:

the exercise weight positioning device has an axle;

the axle located within a cavity of the exercise weight positioning device;

the axle having a first end and a second end;

the first end and the second end of the axle secured to the first side and the second side of the J-cup respectively;

the main body rotatable on the axle.

13. The exercise bench of claim 12, wherein:

the recessed portion is between the first end and the second end of the exercise weight positioning device.

14. The exercise bench of claim 13, wherein:

the exercise weight positioning device is selectively removable from the J-cup.

15. The exercise bench of claim 11, wherein:

the main body is cylindrical.

* * * * *